US008671858B2

(12) United States Patent
Morgante et al.

(10) Patent No.: US 8,671,858 B2
(45) Date of Patent: Mar. 18, 2014

(54) SERVO DRIVEN CRANK ADJUSTED SHIFTING MECHANISM

(75) Inventors: Michael R. Morgante, Chattanooga, TN (US); Paul E. Beatty, Chattanooga, TN (US)

(73) Assignee: Tuftco Corporation, Chattanooga, TN (US)

( * ) Notice: Subject to any disclaimer, the term of this patent is extended or adjusted under 35 U.S.C. 154(b) by 1051 days.

(21) Appl. No.: 12/716,244

(22) Filed: Mar. 2, 2010

(65) Prior Publication Data

US 2010/0224113 A1 Sep. 9, 2010

Related U.S. Application Data

(60) Provisional application No. 61/156,673, filed on Mar. 2, 2009.

(51) Int. Cl.
*D05C 15/08* (2006.01)

(52) U.S. Cl.
USPC ..... 112/80.04

(58) Field of Classification Search
USPC ..... 112/475.23, 80.01, 80.04, 80.23, 80.4, 112/80.73, 220, 302, 80.43, 80.7
See application file for complete search history.

(56) References Cited

U.S. PATENT DOCUMENTS

| | | | | |
|---|---|---|---|---|
| 3,964,408 | A * | 6/1976 | Smith | 112/80.23 |
| 4,173,192 | A * | 11/1979 | Schmidt et al. | 112/80.24 |
| 4,829,917 | A * | 5/1989 | Morgante et al. | 112/80.41 |
| 5,555,826 | A * | 9/1996 | Satterfield | 112/80.04 |
| 5,575,228 | A * | 11/1996 | Padgett et al. | 112/80.41 |
| 5,979,344 | A * | 11/1999 | Christman, Jr. | 112/80.23 |
| 6,920,837 | B2 * | 7/2005 | Keilmann | 112/470.01 |

* cited by examiner

*Primary Examiner* — Tejash Patel
(74) *Attorney, Agent, or Firm* — Miller & Martin PLLC

(57) ABSTRACT

A crank adjusted shifting mechanism having a servo driven eccentric in communication with a drive rod and optional clamping assembly provides for a fast and programmable needle bar shifting mechanism for a tufting machine.

19 Claims, 8 Drawing Sheets

SERVO DRIVEN CRANK ADJUSTED SHIFTING MECHANISM

The present application claims priority to the Mar. 2, 2009 filing date of U.S. provisional patent application Ser. No. 61/156,673, which is incorporated herein.

FIELD OF THE INVENTION

The present invention relates to tufting machines, particularly to the apparatus used to direct shifting of a needle bar across the face of a backing fabric fed through the tufting machine.

BACKGROUND OF THE INVENTION

In the production of tufted fabric, it is well known to displace a sliding needle bar transversely of the base fabric by means of a variety of shifting apparatus. This transverse shifting may be used in order to create various pattern effects, to break up unattractive alignment of longitudinal rows of tufts, and to reduce the effects of streaking which results from variations in colorations of the yarns.

The transverse shifting of needle bars has been accomplished by the use of a variety of devices. Most of the early devices were of a cam driven type with a rotating plate cam driven directly from the tufting machine main drive shaft through a reducer, and engaging cam followers in communication with the needle bar to effect the required displacement. Because of the reliability, simplicity, and relatively low cost of cam drive systems, these systems have been in use for over fifty years and even today remain viable for use in connection with the tufting of certain carpet patterns.

Subsequently, a variety of programmable shifting mechanisms have been utilized, with the advantage that shifting patterns of these systems require only a change in programming, rather than physical replacement of a cam plate. Examples of these programmable shifting devices include pawl and ratchet devices such as are disclosed in U.S. Pat. No. 3,964,408; hydraulic shifters disclosed in U.S. Pat. Nos. 4,173,192 and 4,829,917; pneumatic shifting systems operating in substantially the same fashion as the hydraulic systems; and linear roller screw drive shifters such as are disclosed in U.S. Pat. No. 5,979,344. Each of these programmable devices suffers from some disadvantages in comparison to a cam driven system, most significantly, cost. The increased costs include not only the initial cost of purchase, but also operating costs in maintaining hydraulic or pneumatic equipment as well as the replacement of servo motors in linear drives which must absorb large forces from the needle bar.

However, the cam based systems of the prior art have numerous limitations, and thus are unsuitable for many types of patterning that might be desired. In a conventional cam driven needle bar shifter apparatus, the cam is rotatably driven through a reducing apparatus from the main shaft of the tufting machine and rotates continuously, however, since the lateral shifting of the needle bar must occur only during that portion of the machine cycle when the needles are above the base fabric and the needle plate, so as to avoid interference between the needles and the needle plate, only a portion of the cam circumference is available for controlling the needle bar movement. The remaining portion of the cam circumference is of a constant radius and non-effective for patterning, it merely idles the needle bar and is referred to as the dwell phase. For example, normally the needle bar is shifted or jogged laterally during approximately 90 degrees to 120 degrees of the needle bar reciprocation cycle, this period corresponding to the period the needles are safely free of the needle plate without imposing excessive acceleration forces on the apparatus.

Thus, in a conventional cam driven shifter approximately one quarter to one third of the circumference of the cam provides the pattern, with the remaining three quarters to two thirds of the circumference being merely an idle surface of dwell zone.

A further limitation is that if the surface of the cam is divided into sectors equal in number to the number of stitches in the pattern, the angular distance from a point in one sector to a similarly disposed point in an adjacent sector is the angle through which the cam must rotate for each revolution of the tufting machine shaft, i.e. for each cycle of the needle bar. Because of this, and because of the small surface available for a follower to ride upon each sector of a practical sized cam, the number of sectors into which the cam may be divided, and hence the number of stitches in a pattern produced by the cam, has been limited.

A further limitation upon the number of stitches in a pattern produced by cam is caused by the preferred structure of placing the rotary cam plate adjacent a sliding carrier member in communication with the needle bar, the carrier having a pair of spaced cam followers arranged to engage diametrically opposed portions of the cam. While this arrangement is perfectly satisfactory for shifting, it does have the limitation that the use of two cam followers necessitates a symmetrical cam. In turn, this produces movements of the sliding needle bar which are symmetrical about its datum. Such a machine is therefore restricted to the manufacture of fabrics having patterns which are of a symmetrical or minor image shifting pattern. While this shortcoming has been addressed through the use of two identical cams acting upon a single cam follower as depicted in U.S. Pat. No. 4,201,143, the typical diameters of cam plates for broadloom tufting machines having reached about twenty-four to thirty inches causes such a shifting mechanism to consume a great deal of space adjacent to at least one end of the tufting machine.

SUMMARY OF THE INVENTION

The present invention overcomes these deficiencies of the prior art shifters by providing a crank adjusted mechanism in lieu of a cam profile and through the use of servo motors to independently control the crank mechanism. An object of the invention to provide a shifting mechanism with no physical limit to the number of stitches that can be utilized in a pattern.

It is another object of the invention to provide a shifting mechanism that is not subject to extreme stresses and is relatively compact in comparison to cam driven shifting mechanisms.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
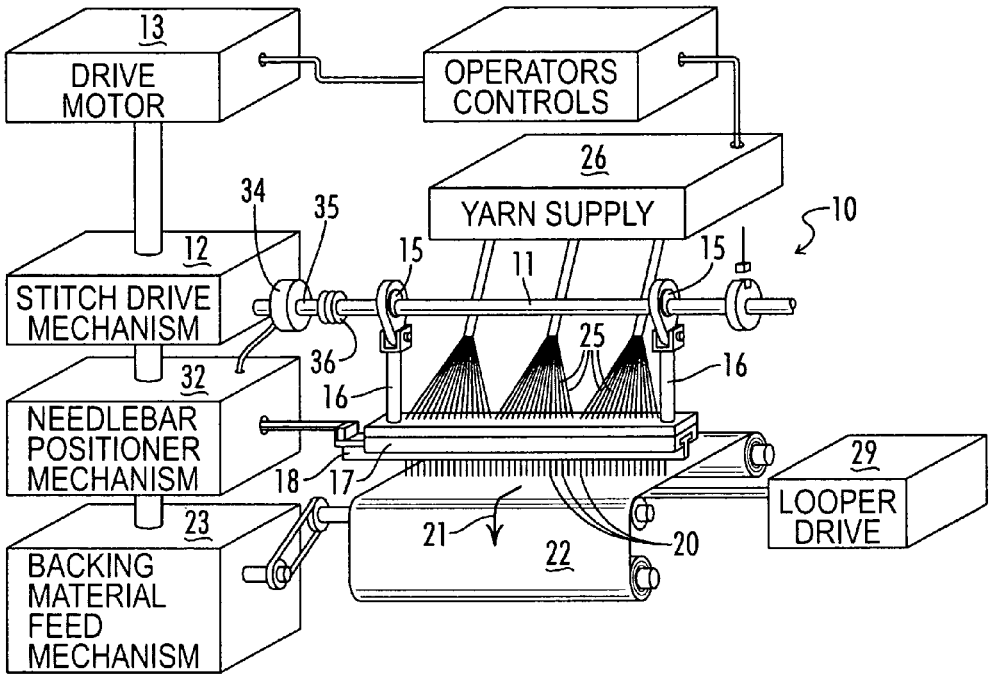
FIG. 1 (PRIOR ART)
FIG. 1 is a front prospective schematic view of multiple needle tufting machine with a needle bar shifting mechanism.

The tufting machine 10 disclosed in FIG. 1 includes a rotary needle shift or main drive shift 11 driven by stitch drive mechanism 12 from a drive motor 13 or other conventional means. Rotary eccentric mechanism 15 mounted upon rotary needle shaft 11 are adapted to reciprocally move the vertical push rod 16 for vertically and reciprocally moving the needle bar slide holder 17 and needle bar 18. The needle bar 18 supports a plurality of uniformly spaced tufting needles 20 in a longitudinal row, or staggered longitudinal rows, extending transversally of the feeding direction of the backing fabric or material 22. The backing fabric 22 is moved longitudinally through the tufting machine 10 by the backing fabric feed mechanism 23 which may be independently driven, or driven from the main drive motor 13, and across a backing fabric support with needle plate and needle plate fingers.

Yarns 25 are fed from the yarn supply 26 to the respective needles 20. As each needle 20 carries a yarn 25 through the backing fabric 22, a hook is reciprocally driven by the looper drive 29 to cross each corresponding needle 20 and hold the corresponding end 25 to form loops. Cut pile tufts are formed by cutting the loops with knives.

The needle bar shifting apparatus 32 is designed to laterally or transversely shift the needle bar 18 relative to the needle bar holder 17 a predetermined transverse distance equal to the needle gauge or multiple of the needle gauge, and in either transverse direction from its normal central position, relative to the backing fabric 22, and for each stitch of the needles 20.

In order to generate input encoder signals for the needle bar shifting apparatus 32 corresponding to each stitch of the needles 20, an encoder 34 may be mounted upon a stub shaft 35, or in another suitable location, and communicate positional information from which the tufting machine controller can determine the position of the needles in the tufting cycle. Alternatively, drive motors may use commutators to indicate the motor positions from which the positions of the associated driven components may be extrapolated by the controller.

Figure 2:
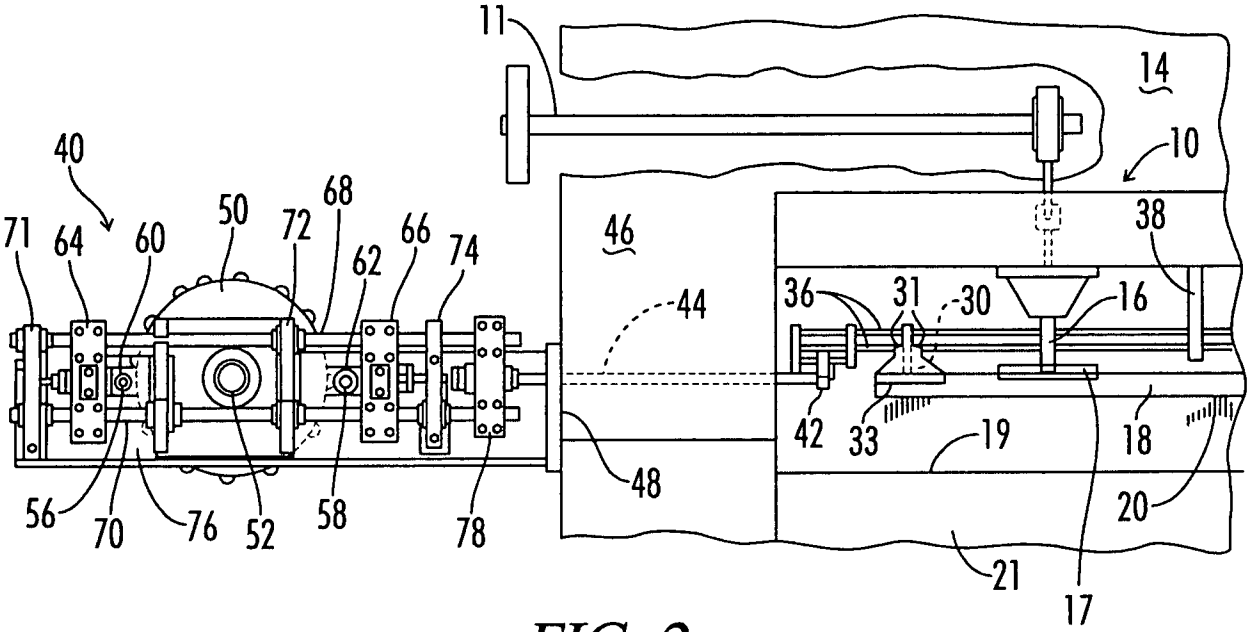
FIG. 2 (PRIOR ART)
FIG. 2 is a fragmentary front elevation view of a tufting machine incorporating a cam driven needle bar shifting apparatus.

Referring now to FIG. 2, a portion of a prior art tufting machine 10 with a cam shifter 40 is illustrated. The tufting machine 10 has a frame comprising a base 21 and a head 14 disposed above the base. The base 21 includes a needle plate 19 over which backing material is fed by conventional means.

Mounted in the head 14 for vertical reciprocation is one of a plurality of push rods 16 to the lower end of which a needle bar slide 17 is carried. A needle bar 18 is slideable longitudinally in a sideway of slide 17 transverse to the direction of the backing material and is conventionally reciprocally driven vertically by the action of the push rods 16. The needle bar 18 carries a plurality of needles 20 adapted to penetrate the backing material upon reciprocation of the needle bar to project loops of yarn there through as the push rods are reciprocated.

In order to drive the needle bar 18 selectively with controlled lateral movement, any number of the cam shifting apparatus of the prior art may be provided. Thus, the needle bar 18 may be provided with a number of upstanding plate members 30 which are straddled by a pair of rollers 31 rotatably mounted on mounting plates 33 secured to brackets (not illustrated) clamped to a pair of laterally extending slide rods 36. The slide rods may be journaled in brackets 38 fixed to the head 14 above the needle bar 18. At the end of the machine adjacent to the needle bar shifting apparatus, generally illustrated as 40, the slide rods 36 are fastened to a clamping block 42 above the bed 21. A drive rod 44 is secured through the clamping block 42 and extends to the end housing 46 of the tufting machine head 14 toward the shifting apparatus 40 and journaled in the end wall 48 for lateral movement transversally relative to the backing material.

The shifting apparatus includes a pattern cam 50 mounted on a rotatable drive shaft 52. The drive shaft 52 is driven by drive apparatus typically in communication with the main drive motor that also powers the needle drive shift 11. Rotation of drive shaft 52 causes rotation of cam 50. A pair of cam follower rollers 56, 58 act against the periphery of the cam 50 at substantially diametrically opposed locations. The followers 56, 58 may be pivotally mounted on brackets 60, 62 respectively fastened to clamping blocks 64, 66, each of which is clamped to a pair of spaced slide rods 68, 70 slidably disposed within linear bearings in bearing blocks 71, 72 and 74 secured to a fixed plate 76. Another clamping block 78 is secured to the rods 68, 70 adjacent to the tufting machine end housing 46 and is fastened to the drive rod 44. Thus, as the cam 50 rotates and drives the followers 56, 58 the slide rods are driven linearly to transmit their motion to the drive rod 44 and thus to the needle bar 18 to affect sliding motion thereof in accordance with the information on the periphery of the cam 50.

Figure 3:
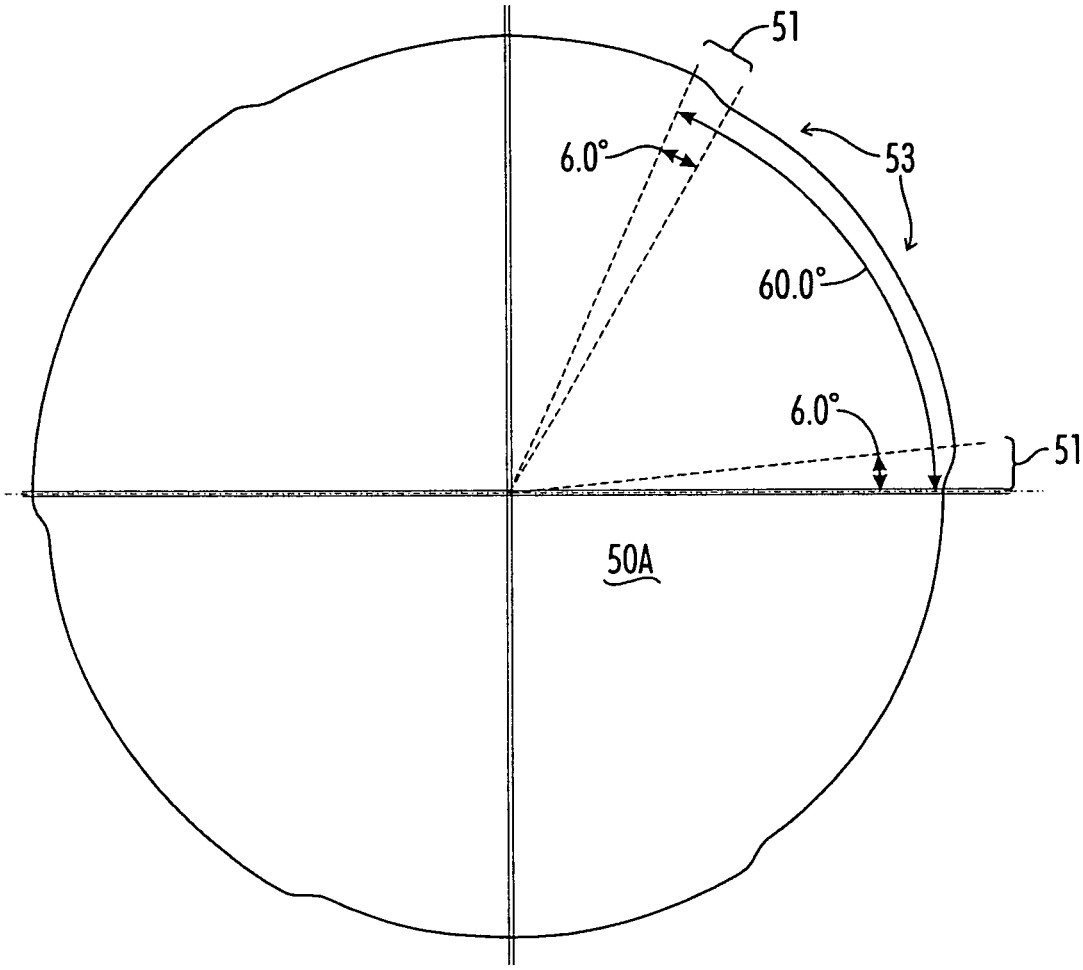
FIG. 3 (PRIOR ART)
FIG. 3 is a prior art cam profile.

FIG. 3 shows a representative prior art cam 50A that might be utilized with a broadloom tufting machine cam shifting apparatus 40. This cam pattern is designed to shift the needle bar in a first direction by one gauge unit for each of three stitches and then to shift in the opposite direction one gauge unit for the following three stitches. In the illustrated cam 50A, each stitch requires 60 degrees of the circumference of the cam. In FIG. 3, the working zone 51 of the cam 50A is only about 6 degrees of the circumference of the cam for each stitch. This means that during the rotation of the cam by 6 degrees, the needle bar must be shifted a gauge increment. A gauge unit will typically be between 1/10 and 3/8 of an inch. The remaining 50 degrees of the cam perimeter is referred to as the dwell zone 53 and is representative of the time during which the needles have been reciprocated downward and have engaged the backing fabric or are located between fingers of the needle plate so that lateral shifting of the needle bar might damage the needles and needle plate fingers. Because of the relatively sharp angle or radius of the curvature of the working zone 51 of cam 50A, the shock that is applied to the shifting apparatus is substantial and the profile of the cam follower must be relatively small so that it will closely conform to the peripherally of the cam. While the relatively small working zones 51 of cam 50A forcibly demonstrate the type of shock and forces that are applied when laterally shifting a needle bar, similarly acute stresses are placed upon the tufting machine when shifting with inverse roller screw or hydraulic shifting apparatus even at moderate tufting speeds.

Figure 4:
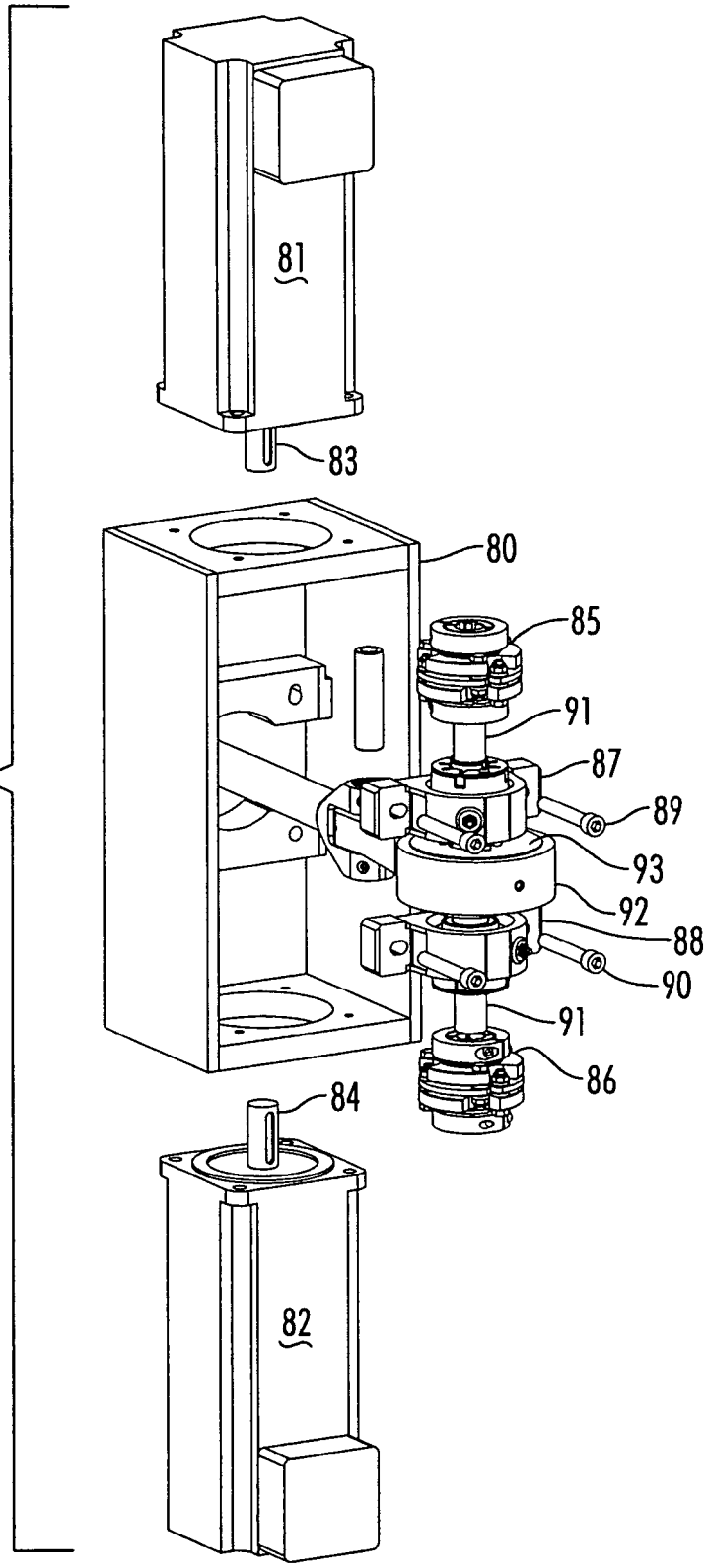
FIG. 4 is a partially exploded view of a crank positioning mechanism according to the invention with two drive motors.
Figure 5A:
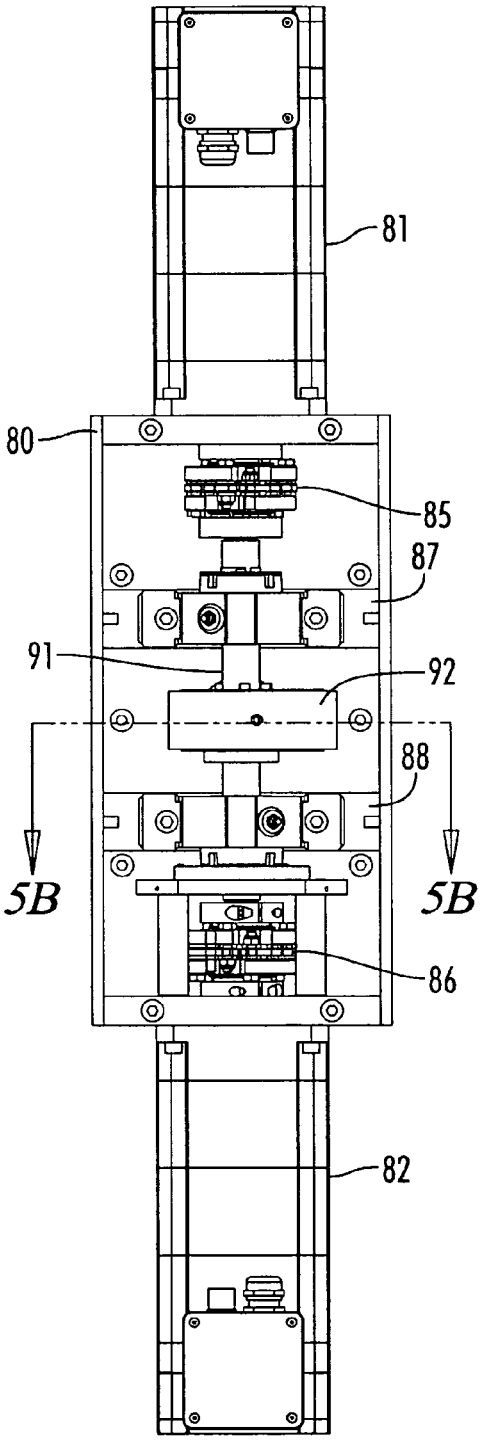
FIG. 5A is an end plan view of the crank positioning mechanism of FIG. 4.
Figure 5B:
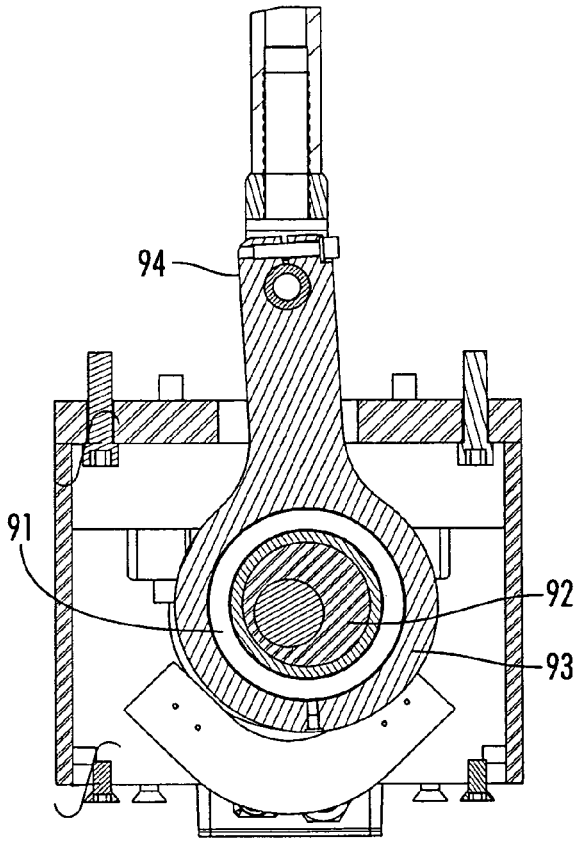
FIG. 5B is a sectional view of the crank positioning mechanism of FIG. 5A taken along line B-B.
Figure 6:
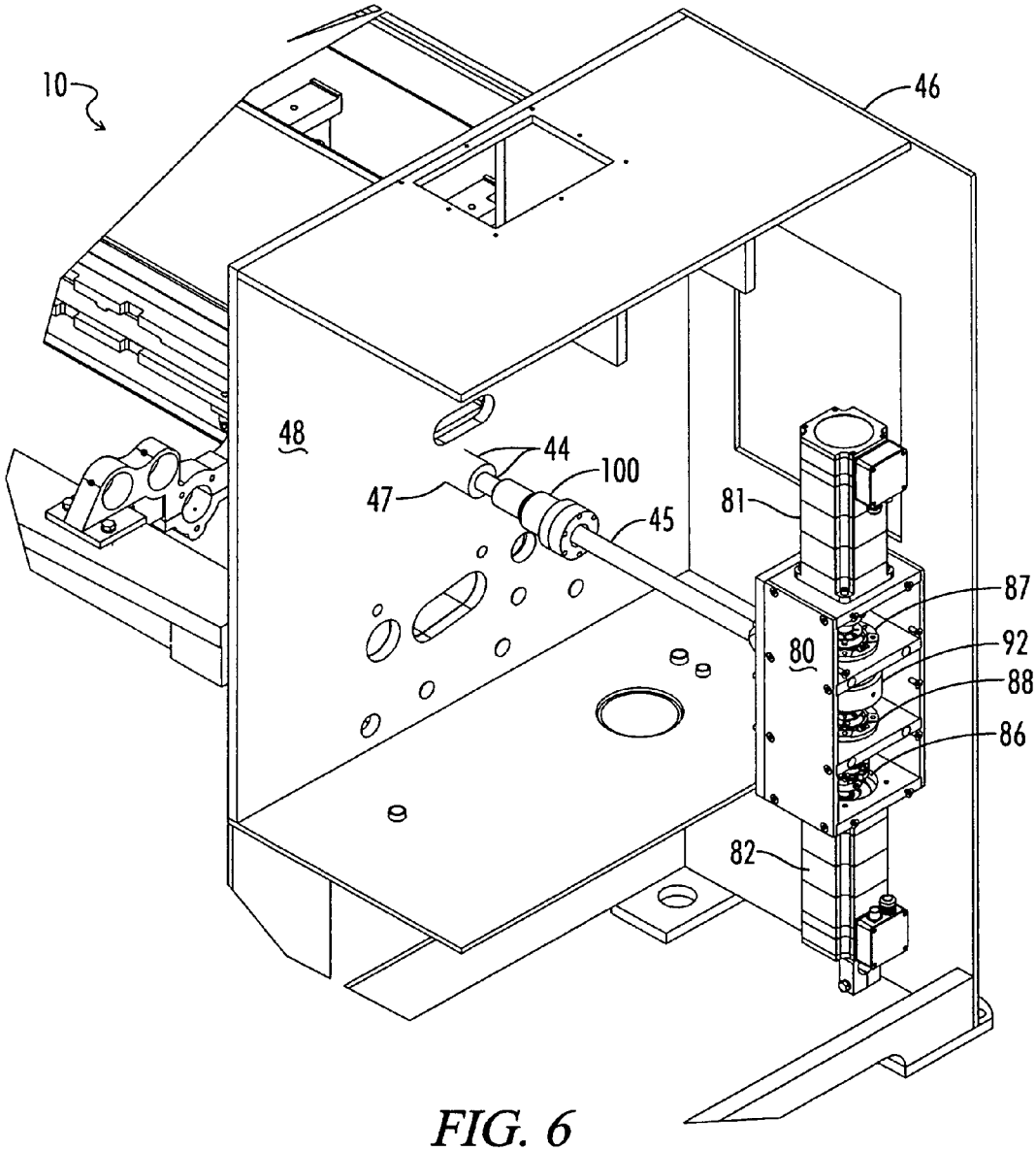
FIG. 6 is a partial sectional front perspective view of a crank positioning and clamp mechanism mounted at one end of a tufting machine.

Therefore, a crank adjusted shifting mechanism as illustrated in FIGS. 4-6 provides advantageous improvement to the tufting machine needlebar shifting art. In the illustrated embodiment, housing 80 is fitted with an upper servo drive motor 81 and lower servo drive motor 82 having respective drive shafts 80 and 84. The upper drive shaft 83 enters the housing 80 and is received in clamping assembly 85 while the lower drive shaft 84 is received in the housing 80 and secured in the lower clamping assembly 86. By virtue of the clamping assemblies 85, 86 the rotation of drive shafts 83, 84 is transmitted to the cam drive shaft or axle 91. The axle 91 is supported in upper bearing assembly 87 which is secured by fasteners 89 and lower bearing assembly 88 secured by fasteners 90 into the frame of housing 80. The axle 91 and axis of rotation of the eccentric 92 are preferably normal to the transverse shifting direction. The servo drive motors 81, 82 are in communication with a controller that directs operation of the motors in accordance with pattern information and in synchronization with the reciprocation of the needles through the backing fabric.

Figure 10A:
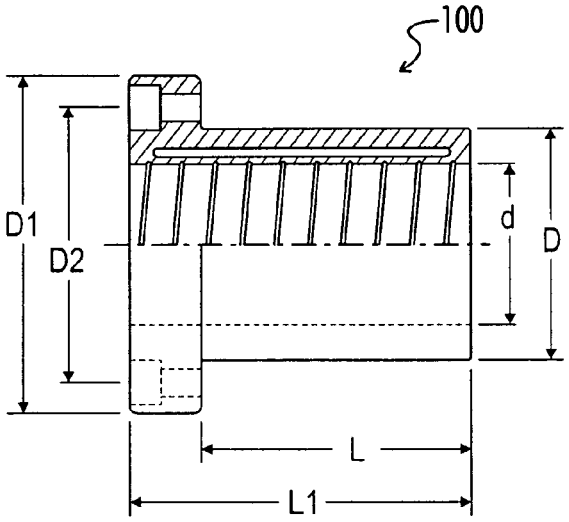
FIG. 10A is a side sectional view of a hydraulic shaft clamp.
Figure 10B:
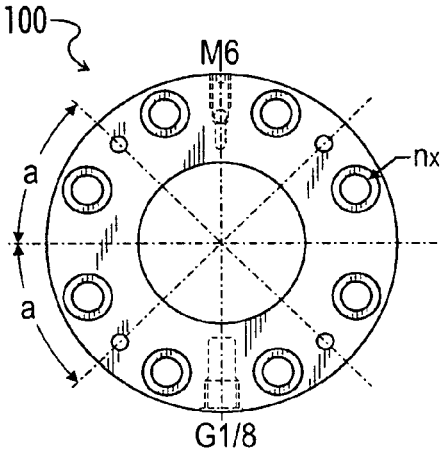
FIG. 10B is an end plan view of the clamp of FIG. 10A.

The crank adjusted shifting mechanism is shown assembled in FIG. 5A and a sectional view is provided in FIG. 5B where the eccentric 92 is shown mounted above the drive shaft 91 and the eccentric strap or collar 93 encompasses the eccentric. The collar 93 encircles the eccentric 92 and on one side has an eccentric rod or a shaft proceeding out of housing 80 to a pin 94 connecting to drive rod 45 shown in FIG. 6. In FIG. 6 it can be seen that the crank adjusted shifting mechanism and its housing 80 are mounted in the end housing 46 or adjacent to said end housing and shaft 45 proceeds to a clamp 100 and thence to drive rod 44 which is journaled in bearing 47 to pass through end wall 48 of tufting machine 10. A representative clamping apparatus would be the ETP-Octopus C hydraulic hub-shaft connection available from ETP Transmission AB, as illustrated in FIGS. 10A-10B.

Figure 7:
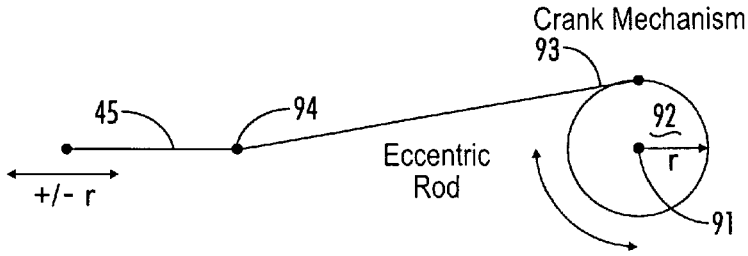
FIG. 7 is a top plan schematic showing the operation of a crank positioning mechanism according to the invention.
Figure 8:
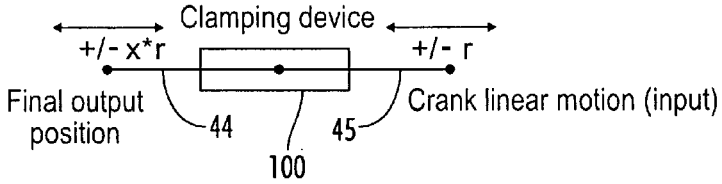
FIG. 8 is a top plan schematic of a clamping device according to the invention.
Figure 9:
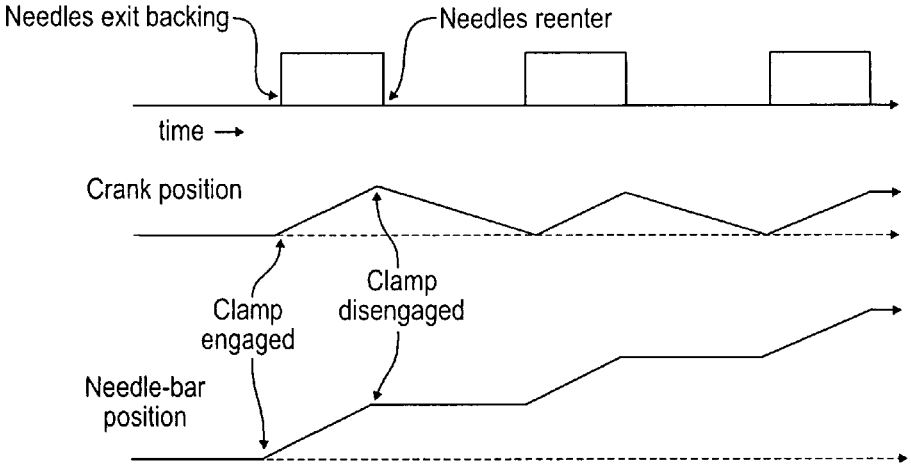
FIG. 9 is a schematic timing illustration of reciprocation of the needles and lateral positioning of the needles utilizing the crank and clamp mechanism.

FIGS. 7-9 illustrate the operation of the cam adjusted mechanism. As is shown in FIG. 7, a rotary to linear motion conversion is accomplished by operation of the rotary crank mechanism. For a rotation of 180 degrees of the crank mechanism, a linear motion of + or − the throw of the eccentric results. This permits a rotation of 30, 45 or even 60 degrees of rotation of the eccentric to move the needle bar a single gauge unit, so that there is relatively vast working surface in comparison to traditional cams. While a variety of configurations of the eccentric 92 may be utilized, a circular profile with an axis of rotation offset from the geometric center of the eccentric is preferred. Elliptical or similar non-circular profiles generally entail the use of followers instead of a collar, but may provide variations in profile curvature to optimize the acceleration and deceleration of movement of the needle bar, it being understood that gradual changes in profile curvature are suitable for this purpose, as long working zones are available. If non-circular profiles are employed, it may be necessary to change profiles with pattern changes. Servo motors are coupled to rotate the axle 91 and allow for precise positioning of the rotary position of the crank mechanism. The speed of servo motor rotation throughout the movement of the needle bar may also vary to optimize its acceleration and deceleration.

Since there is a desire to optimize the mechanical coupling of the servo motor with the load, an inertia matching of the reflected needle bar weight with the motor rotor inertia, the amount of eccentricity provided by the eccentric 92 will typically be in the range of 0.3 to 0.75 inches. The lower end of this range provides sufficient linear stroke for many high speed streak breaking tufting applications, while the upper end of the range allows for a total transverse needle movement of 1.5 inches. However, when there is the desire to further increase the linear motion provided by the crank adjusting mechanism, a clamping mechanism as illustrated in operation in FIG. 8 can be provided. The purpose the clamp is to connect and disconnect the crank mechanism from the needle bar. During the portion of the cycle when the needle bar is to be moved, the clamp connects to the needle bar and moves it to the next allowed position. At this point the clamp can be disengaged freeing the crank mechanism to return to its original position without affecting the needle bar position. At this point the clamp can be reengaged with the needle bar and the bar further extended to a gauge position beyond the original range of the crank mechanism. The needle bar can be extended or retracted in a similar fashion so that the needle bar can be shifted by the amount of eccentricity in each of several steps and retracted in the same fashion. A timing diagram illustrating the process of sequentially moving the needle bar three steps in one direction utilizing the clamp mechanism is shown in FIG. 9.

The crank adjusted shifting mechanism of this invention provides a very robust bearing support system with upper and lower roller bearing assemblies 87, 88. The operation of the crank system is not limited by cam follower speeds or the strength of small cam follower pieces needed to conform to relatively small work zones on traditional cams. The crank system also has no limit to the number of idle or no movement stitches that would result in extreme pressure angles or extremely large cams for the shifted stitches in a standard cam system. The crank mechanism allows for the coupling of upper and lower motors 81, 82 to drive the eccentric shaft 91 and thereby provides relatively higher accelerations for shifting the needle bar at higher machine speeds. The crank mechanism can be used with or without the clamp mechanism depending on the necessary total shifting range in the pattern. When utilized with a clamp 100, full graphic needle bar working range is attainable even utilizing an eccentric 92 with relatively small throw value. The size and throw of the eccentric can be tailored to match the needle bar reflected and servo motor inertias. The crank mechanism inertia is less than half that in most traditional cam figurations which allows for higher accelerations of the needle bar. The crank mechanism also works with relatively small eccentrics in comparison to the 24-30 inch cams of traditional cam attachments and thus requires less than half the additional space at the end of a tufting machine and does not require substantial external bracing. The eccentric throw value can be tailored to the specific drive motor and tufting machine gauge combination to provide an optimum inertia/torque ratio. Thus, it can be seen that the crank adjusted shifting mechanism provides numerous advantages over the prior art in speed of operation, cost, convenience, and programmability of operation.

All publications, patent, and patent documents mentioned herein are incorporated by reference herein as though individually incorporated by reference. Although preferred embodiments of the present invention have been disclosed in detail herein, it will be understood that various substitutions and modifications may be made to the disclosed embodiment described herein without departing from the scope and spirit of the present invention as recited in the appended claims.

We claim:

1. A tufting machine of the type having a slideable needle bar supporting a plurality of needles transversely of said machine, yarn being fed to said plurality of needles, and the needle bar being reciprocally driven to cause the needles to penetrate a backing material, and a servo motor driven crank mechanism connected to the needle bar for causing the needle bar to shift in a transverse direction, wherein the servo driven crank mechanism comprises:

a drive rod with a first end for communicating transverse movement to the needle bar and a second end;

a collar encircling an eccentric and having an eccentric rod pivotally connected to the second end of the drive rod;

a first servo motor having a drive shaft to communicate rotational movement to the eccentric; and a controller communicating with the servo motor to direct operation of the crank mechanism in accordance with pattern information.

2. The tufting machine of claim 1 wherein the eccentric has a throw of between 0.3 and 0.75 inches.

3. The tufting machine of claim 1 wherein a second servo motor, axially opposite the first servo motor from the eccentric, has a drive shaft to communicate rotational movement to the eccentric.

4. A tufting machine of the type having a slideable needle bar supporting a plurality of needles transversely of said machine, yarn being fed to said plurality of needles, and the needle bar being reciprocally driven to cause the needles to penetrate a backing material, and a servo motor driven crank mechanism connected to the needle bar for causing the needle bar to shift in a transverse direction, wherein the servo motor driven crank mechanism has a first drive rod that is joined to a second drive rod connected to the needle bar in an actuatable clamp.

5. The tufting machine of claim 4 wherein the clamp is a hydraulic clamp operated by a controller in accordance with pattern information to shift the needle bar a transverse distance greater than the throw of an eccentric in the crank mechanism.

6. A servo motor driven crank for shifting the needle bar of a tufting machine comprising:

a drive rod with a first end for communicating transverse movement to the needle bar and a second end;

a collar encircling an eccentric and having an eccentric rod pivotally connected to the second end of the drive rod;

a first servo motor having a drive shaft to communicate rotational movement to the eccentric; and a controller communicating with the servo motor to direct operation of the crank mechanism in accordance with pattern information.

7. The servo driven crank mechanism of claim 6 wherein the eccentric has to throw of between 0.3 and 0.75 inches.

8. The servo driven crank mechanism of claim 6 wherein a second servo motor, axially opposite the first servo motor from the eccentric, has a drive shaft to communicate rotational movement to the eccentric.

9. The servo driven crank mechanism of claim 6 wherein axis of rotation of the eccentric is normal to the transverse movement of the needle bar.

10. The servo driven crank mechanism of claim 6 wherein a first bearing support is located intermediate the first servo motor and the eccentric, and a second bearing support is located between the second servo motor and the eccentric.

11. The servo driven crank mechanism of claim 6 wherein the servo motor driven crank mechanism has a first drive rod that is joined to a second drive rod connected to the needle bar in an actuatable clamp.

12. The servo driven crank mechanism of claim 6 wherein the clamp is a hydraulic clamp operated by a controller in accordance with pattern information to shift the needle bar a transverse distance greater than the throw of an eccentric in the crank mechanism.

13. A method shifting a needle bar in a tufting machine of the type having a slideable needle bar supporting a plurality of needles transversely of said machine, yarns being fed to said needles, a drive mechanism connected to the needle bar for causing the needle bar to reciprocate toward and away from a backing fabric thereby causing the plurality of needles to penetrate the backing fabric, and a servo driven crank adjusted shifting mechanism for transversely shifting the needle: bar comprising the steps of:

(a) reciprocating the needle bar away from the backing fabric so that the needles are not penetrating the fabric;

(b) operating a servo motor to rotate an eccentric in a first direction in the servo driven crank adjusted shifting mechanism;

(c) the rotation of the eccentric moving a drive rod connected to the needle bar and causing the needle bar to move transversely;

(d) reciprocating the needle bar toward the backing fabric so that needles are penetrating the fabric; and (e) stopping the rotation of the eccentric while the needles are penetrating the backing fabric.

14. The method of shifting and needle bar in a tufting machine of claim 13 wherein the eccentric is rotated in a clockwise direction by at least 30 degrees.

15. The method of shifting and needle bar in a tufting machine of claim 13 wherein the eccentric is rotated in a counter-clockwise direction by at least 30 degrees.

16. The method of shifting and needle bar in a tufting machine of claim 13 wherein a controller directs the rotation of the servo motor in accordance with pattern information, and in synchronization with the reciprocation of the needle bar.

17. The method of shifting and needle bar in a tufting machine of claim 13 wherein a collar mounted about the eccentric translates the rotational movement of the eccentric into longitudinal movement of a first dive rod.

18. The method of shifting and needle bar in a tufting machine of claim 17 wherein actuatable clamp serves to join the first drive rod to a second drive rod that is connected to the needle bar, and comprising the additional steps of:

actuating the clamp to release the first drive rod from the second drive rod after moving the needle bar transversely in step (c);

operating the servo motor to rotate the eccentric in a second opposite direction and thereby moving the first drive rod relative to the second drive rod;

actuating the clamp to join the first drive rod and the second drive rod;

operating the servo motor to rotate the eccentric in the first direction to move the drive rod connected to the needle bar and causing the needle bar to move further transversely.

19. The method of shifting and needle bar in a tufting machine of claim 17 wherein an actuatable clamp serves to join the first drive rod to a second drive rod that is connected to the needle bar and comprising the steps of:

actuating the clamp to release the first drive rod from the second drive rod after the needles are penetrating the backing fabric and the rotation of the eccentric is stopped in step (e);

operating the servo motor to rotate the eccentric in a second opposite direction and thereby moving the first drive rod relative to the second drive rod;

stopping the rotation of the eccentric;

actuating the clamp to join the first drive rod and the second drive rod.

* * * * *